United States Patent [19]

Dremel

[11] 4,397,258

[45] Aug. 9, 1983

[54] MACHINE FOR ONE-SIDED COATING OF THIN SHEETS

[75] Inventor: Bernhard Dremel, Appenzell, Switzerland

[73] Assignee: Ulrich Steinemann AG, Maschinenfabrik, St. Gallen, Switzerland

[21] Appl. No.: 327,095

[22] Filed: Dec. 3, 1981

[30] Foreign Application Priority Data

Dec. 11, 1980 [CH] Switzerland ..... 9153/80

[51] Int. Cl.[3] ..... B05C 1/02; B05C 13/00

[52] U.S. Cl. ..... 118/50; 118/62; 118/239; 118/249

[58] Field of Search ..... 118/62, 50, 239, 249; 198/689

[56] References Cited

U.S. PATENT DOCUMENTS

| | | | |
|---|---|---|---|
| 3,861,351 | 1/1975 | Bonwit et al. | 118/62 X |
| 3,889,801 | 6/1975 | Boyer | 198/689 |
| 4,006,704 | 2/1977 | Perdoni | 118/62 X |

OTHER PUBLICATIONS

Greuling et al., Paper Transport Mechanism, IBM Technical Disclosure Bulletin, vol. 15, No. 8, Jan. 1973.

*Primary Examiner*—John P. McIntosh

*Attorney, Agent, or Firm*—Weingarten, Schurgin, Gagnebin & Hayes

[57] ABSTRACT

An improved machine for coating one side of thin sheets, particularly sheets of paper. In this machine, sheets of paper coated by means of an applicator roller are detached from the roller by compressed air ejected from an air nozzle and then are passed onto a conveyor belt which conveys them away from the roller. The belt is provided with openings, and the upper strand of this belt passes over a casing forming part of a vacuum device which also has one or more openings and which includes a vacuum pump. Because of the resulting vacuum which acts through the openings in the belt and in the casing, the sheets are more rapidly detached from the applicator roller and more uniformly placed upon the conveyor belt.

11 Claims, 3 Drawing Figures

MACHINE FOR ONE-SIDED COATING OF THIN SHEETS

FIELD OF THE INVENTION

This invention relates generally to a machine for the one-sided coating of thin sheets, and more particularly to an improved apparatus for deposition of the coated sheets on a conveyor.

BACKGROUND OF THE INVENTION

A known machine for coating sheets of paper is described in Swiss Patent Application Ser. No. 6112/79 and includes an applicator roller which provides generally thin paper sheets with a coating on one side thereof as they pass therethrough. Since the sheets tend to adhere to the applicator roller after application of the coating, an air nozzle is provided which produces an air flow directed oppositely of the direction of rotation of the roller and approximately tangentially thereto. This air flow detaches each sheet of paper from the roller for deposition on a conveyor belt to convey the sheet away from the roller.

It has been found that although the air nozzle detaches the sheets from the applicator roller, deposition of the sheets on the conveyor belt is not accomplished completely satisfactorily both with respect to the time therefor and to the manner thereof. While the compressed air flow over the entire width of the sheet does reliably detach the sheet from the roller, air flows and pressure differences occur in a direction transverse of the longitudinal sheet length, and this fact together with the normal air pressure present on the back or bottom of the sheet causes a non-uniform detachment of the sheet and a deflection or sagging thereof. This leads to the so-called ear effect, in which the sheet, when viewed in the transverse direction, is raised considerably at its center and in which the two longitudinal ends are only slightly separated from the applicator roller and therefore project upwardly like ears. The main reason for this effect is that after detachment of the sheet, the air supplied by the air nozzle flows away much more rapidly at the longitudinal ends of the sheet than in the center of the sheet, so that the longitudinal ends of the sheet are deflected to a lesser extent. However, the air striking the center of the sheet must first find space for flowing away and creates this space by causing a greater deflection at the center of the sheet.

BRIEF SUMMARY OF THE INVENTION

An object of this invention is to accelerate the flow of air away from the thin sheets while not only avoiding the aforementioned transverse deflection, but also accelerating the deposition of the sheets on the conveyor belt to increase the performance of the machine.

According to the invention, the above described problems associated with known machines are overcome by a machine which includes a roller for applying a coating to thin sheets, a conveyor belt for conveying the coated sheets away from the roller, and an air nozzle for detaching the sheets adhering to the roller for deposition on the conveyor belt. The conveyor belt includes openings thereon, and a device for providing a vacuum associated with the conveyor belt provides suction through the openings to draw the thin sheets onto the conveyor belt.

DESCRIPTION OF THE DRAWINGS

The invention will be more fully understood from the following detailed description taken in conjunction with the accompanying drawing, in which.

DETAILED DESCRIPTION OF THE INVENTION

Figure 1:
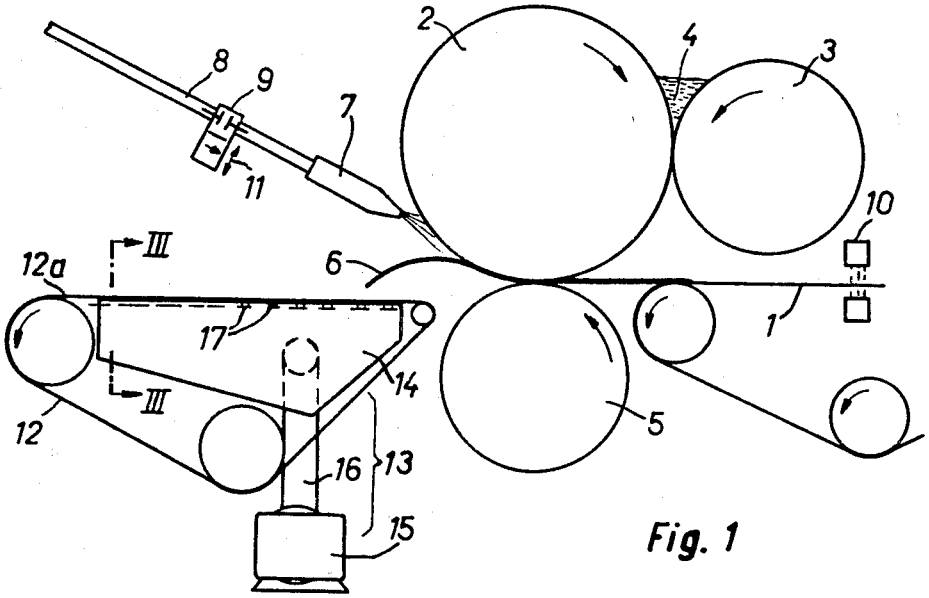
FIG. 1 is a diagrammatic view of a portion of the machine of this invention.

A conveyor belt 1, only a portion of which is shown in FIG. 1 for clarity, supplies sheets of paper to an applicator roller 2 which coats the top surface of the paper. The conveyor belt 1 and applicator roller 2 move or rotate in the direction shown in FIG. 1 by the arrows on the conveyor belt guide pulleys 28 and on roller 2. Together with a metering roller 3, applicator roller 2 forms a tank 4 for the coating liquid which, by adhesion to the surface of applicator roller 2, passes downwardly and is applied to the top surface of a paper sheet 6 disposed on an opposed roller 5. An air nozzle 7 connected to a pipe 8 leading from a compressed air source (not shown), detaches the sheet 6 adhering to applicator roller 2 by a compressed air blast. The control valve 9 inserted in pipe 8 is appropriately controlled by a sensor 10 disposed on the opposite side of rollers 2 and 5, and valve 9 is moved as shown by the double arrow 11. The detached sheets fall on a conveyor belt 12 which serves to transport the sheets away.

Conveyor belt 12 operates in cooperation with a vacuum generating device 13 which includes a casing 14 on which the upper strand 12*a* of the conveyor belt rests and a vacuum pump 15 connected by a pipe 16 to casing 14. The top 14*a* of the casing is provided with one or more openings 17, the construction of which will be described hereinafter. Openings 17 cooperate with openings 18 in conveyor belt 12.

When vacuum pump 15 is in operation, a vacuum is formed within casing 14 which acts over a relatively large area above strand 12*a* through openings 17 and 18. This area extends to the vicinity of applicator roller 2. An appropriate vacuum in casing 14 is between 50 mm and 300 mm of water. The suction action therefrom on the back or bottom surface of sheet 6 causes a faster movement in the direction of conveyor belt 12 of that part of the sheet already detached by air nozzle 7. As a result, the air expelled from the air nozzle can escape more rapidly. This feature overcomes the aforementioned sagging or deflection of sheet 6 in a transverse direction and indirectly also prevents any displacement and/or rotation of the detached sheet with respect to the conveyor belt, so that more regular deposition of the sheets on the conveyor belt is ensured. At the same time, the performance of the machine is improved.

Figure 2:
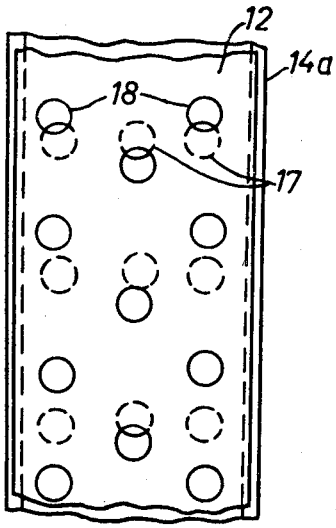
FIG. 2 is a partially cutaway view of a portion of the conveyor belt and the casing of the machine of FIG. 1.
Figure 3:
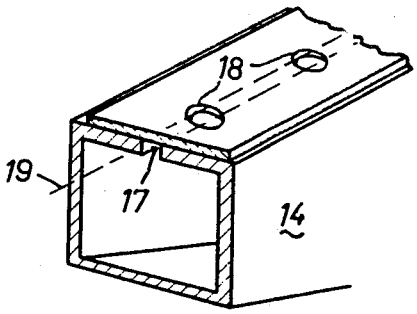
FIG. 3 is a partial, perspective cross-sectional view along line 3—3 of FIG. 1.

Openings 17 and 18 can be constructed in several different ways and FIGS. 2 and 3 show two possibilities. According to FIG. 2, both conveyor belt 12 and casing 14 can have several parallel rows of openings 17 and 18 respectively which are coincident with one another. Preferably, one row of openings in either the conveyor belt or the casing, which in this case is the central row of openings 18 in the conveyor belt, is longitudinally displaced with respect to the other two rows in the respective one of the conveyor belt or the casing, but the corresponding row of openings in the other one of the conveyor belt or the casing, which in this case is the central row of openings 17 in the casing, is not longitudinally displaced with respect to the other two rows thereof. Thus, all of the openings do not simultaneously coincide or mask one another, and this relationship reduces the formation of pressure waves. The rows of openings 17 need not extend over the entire longitudinal length of top surface 14*a*, and the vacuum need only act over part of the length of conveyor belt strand 12*a*.

Only one row of openings 18 is required in the conveyor belt, as shown in FIG. 3, when less stringent demands exist. This row is located generally along the axis 19 of the conveyor belt, and below this row is a single opening 17 in the form of a slot which is provided in casing top surface 14*a*. Opening 17 either extends along the entire length of top surface 14*a* or only along a part thereof. This invention also includes a conveyor belt made from a woven material and a top surface 14*a* of the casing made from a lattice or sieve. The openings 18 and 17 then would be formed by the interstices in the mesh of the fabric and the lattice or sieve respectively.

Preferably, conveyor belt 12 has a higher running speed than the circumferential speed of applicator roller 2. This relationship produces a stretching of sheet 6 which is subject to the suction action and not only improves the regularity of deposition of the sheets onto the conveyor belt, but also reduces the time required to completely detach the sheets from the applicator roller 2. The performance of the machine is further increased thereby. The different in the aforementioned speeds can be up to 10% of the circumferential speed of roller 2.

The above description is exemplary, and modifications and improvements are intended to fall within the scope of this invention as defined solely in the following claims.

What is claimed is:

1. A machine for coating of one side of a sheet not subject to the so-called ear effect, comprising:

a roller for applying a coating to the sheets;

a conveyor belt having openings formed therethrough and therealong, and positioned adjacent the roller to directly receive a coated sheet;

means for detaching the coated sheets from the roller, said detaching means including co-operative first and second means;

said first means is positioned adjacent said roller for providing an air jet directed to one side of the coated sheets;

said second means is coupled to said conveyor belt positioned adjacent said roller for providing a drawing action through said openings directed to the other side of the coated sheets;

the force of said air jet directed to the one side of said coated sheet cooperates with the force of said drawing action directed to the other side of the coated sheets to effect the detachment of the coated sheets from said roller, and onto said conveyor belt whereby; the so-called ear-effect is substantially eliminated.

2. A machine according to claim 1 wherein said second means comprises:

a casing having a top surface provided with at least one opening coinciding with said openings in said conveyor belt passing over said top surface; and a vacuum pump connected to said casing.

3. A machine according to claim 2 wherein said second means operates only over a portion of the length of said conveyor belt and said casing.

4. A machine according to claim 2 or 3 wherein a pressure in the range of 50 mm to 300 mm of water prevails in said casing.

5. A machine according to claim 1 wherein the running speed of said conveyor belt exceeds the circumferential speed of said roller.

6. A machine according to claim 5 wherein the difference between the running speed of said conveyor belt and the circumferential speed of said roller is in the range of 0% to 10% of the circumferential speed of said roller.

7. A machine according to claim 2 or 3 wherein the openings in said conveyor belt and in said casing are distributed over substantially the entire respective transverse width of said conveyor belt and said top surface of said casing.

8. A machine according to claim 7 wherein the openings in said conveyor belt are formed by the interstices of the mesh of a textile fabric.

9. A machine according to claim 7 wherein the openings in said top surface of said casing are formed between the meshes of a lattice.

10. A machine according to claim 2 or 3 wherein the openings in the conveyor belt are located in a row generally along its longitudinal axis and the opening in said top surface of said casing comprises a unitary slot extending generally along the longitudinal axis of said belt.

11. Apparatus for coating one side of a thin sheet not subject to the so-called ear effect, comprising:

a roller rotating at a first speed for applying a coating to the sheets;

a conveyor belt, adjacent the roller, having openings formed therethrough and therealong rotating at a second speed that exceeds said first speed;

first means adjacent said roller for providing an air jet;

second means, including a casing having a top surface provided with at least one opening coinciding with said openings in said conveyor belt and including a vacuum pump connected to said casing having a pressure in the range of 50 mm to 300 mm of water, for providing a drawing action through said openings, said drawing action co-operates with said air jet to detach coated sheets from said roller and onto said conveyor belt.

* * * * *